United States Patent [19]

Smith et al.

[11] Patent Number: 4,848,042

[45] Date of Patent: Jul. 18, 1989

[54] FLUID JET CUTTING SYSTEM WITH STANDOFF CONTROL

[75] Inventors: R. Craig Smith; John J. Allevato, both of Arlington, Tex.

[73] Assignee: LTV Aerospace and Defense Company, Dallas, Tex.

[21] Appl. No.: 94,373

[22] Filed: Sep. 9, 1987

[51] Int. Cl.[4] ..... B24C 3/00

[52] U.S. Cl. ..... 51/410; 51/413; 51/439; 83/53; 83/177

[58] Field of Search ..... 51/410, 413, 439, 415, 51/268, 274; 83/53, 177

[56] References Cited

U.S. PATENT DOCUMENTS

| | | | |
|---|---|---|---|
| 2,534,958 | 12/1950 | Deming . | |
| 3,891,157 | 6/1975 | Justus | 242/56.2 |
| 3,978,748 | 9/1976 | Leslie et al. | 83/53 |
| 3,992,819 | 11/1976 | Schmall | 51/413 |
| 4,263,497 | 4/1981 | Cozzini | 219/138 |
| 4,651,476 | 3/1987 | Marx et al. | 83/53 |
| 4,658,683 | 4/1987 | Phillips | 83/53 |

FOREIGN PATENT DOCUMENTS

| | | | |
|---|---|---|---|
| 2411069 | 8/1979 | France | 83/177 |

OTHER PUBLICATIONS

Earle, III, George A., "Automatic Trimming of Composite Panels," SAE Paper No. 861,675, Oct. 1986, Society of Automotive Engineers.

*Primary Examiner*—Frederick R. Schmidt
*Assistant Examiner*—Robert A. Rose
*Attorney, Agent, or Firm*—James M. Cate; Stephen S. Sadacca

[57] ABSTRACT

A system for closely controlling the standoff distance of a nozzle in a remotely controlled fluid jet abrasive cutting system. The system comprises a head assembly having a support section and a nozzle body. Control means move the head assembly along a desired cutting path relative to the workpiece. A nozzle is mounted in the nozzle body and oriented to dispense cutting fluid along an axis directed against the workpiece. The nozzle body and the support section are interconnected by means which function to bias the nozzle body relative to the mounting section in a direction along the cutting axis of the nozzle. The nozzle body is provided with a standoff member which is adapted to ride on a portion of the workpiece and which projects beyond the nozzle tip by a distance sufficient to hold the nozzle off of the workpiece by the desired standoff distance.

14 Claims, 2 Drawing Sheets

FLUID JET CUTTING SYSTEM WITH STANDOFF CONTROL

TECHNICAL FIELD

This invention relates to fluid jet abrasive cutting and more particularly to remotely controlled fluid jet abrasive cutting with accurate standoff control of the jet nozzle relative to the workpiece.

ART BACKGROUND

One technique for cutting workpieces such as metal panels and highly contoured composite panels used as air frame components involves the use of fluid abrasive cutting systems. These systems employ an injector nozzle which dispenses a liquid, such as water, entraining an abrasive material at extremely high pressures. The operating pressures of such systems normally range from 30,000 to 60,000 psi. In a typical application, the high pressure liquid flowing through the nozzle induces a vacuum in a supply line leading to a source of an abrasive grit such as garnet, silica, alumina or the like. Typical abrasive constituents include 100 mesh abrasives for composite materials such as composite laminates of graphite-epoxy or Kevlar Fiber reinforced resins and 60–80 mesh abrasives for metals such as titanium and aluminum.

Systems for the control of the high pressure nozzle is it moves relative to the workpiece being cut range from the simple to the very sophisticated. A relatively simple arrangement using a manually movable nozzle mounted in a guide to bevel the edge of a workpiece is disclosed in U.S. Pat. No. 4,658,683 to Phillips. In Phillips, the nozzle is secured in a collar which is mounted in a guide having a U-shaped configuration. The nozzle is mounted relative to the guide at a appropriate angle to form a beveled surface along the edge of the workpiece. The U-shaped guide is provided with two arms which straddle the position at which the jet is directed at the workpiece and terminate in down turned foot sections so as to position the cutting jet accurately and ensure that it cuts along a path which is parallel to the front face of the workpiece.

Another system which employs a spreading table and conveyor system by which the workpiece may be moved relative to the nozzle is disclosed in U.S. Pat. No. 3,978,748 to Leslie, et al. In this system, a nozzle is mounted on a suitable carriage which is movable along rails of a transport mechanism above a suitable workpiece support such as a wire net tensioned on rollers. A catcher tube is mounted below the wire net opposite the nozzle. The nozzle support is provided with a sensor in the form of having an extendable probe which can be lowered to detect the workpiece surface. A hydraulic mechanism is used to raise and lower the nozzle to provide the appropriate standoff distance based upon the operation of the sensor probe.

A substantially more sophisticated system for robotically controlled abrasive jet cutting is disclosed in Earle, III, George A., "Automatic Trimming of Composite Panels", SAE Paper No. 861,675, October 1986, Society of Automotive Engineers. As disclosed there, the robotic cutting system involves a cutting head which is moved relative to a workpiece by operation of a six-axis gantry robot system. The workpiece to be cut is placed on a suitable support surface and the location of the workpiece relative to the gantry system is accurately determined by a visual control system which senses targets in the workpiece and makes appropriate changes in the program matrix to accommodate the actual position of the workpiece. The cutting head can be moved under the control of a central controller through a three axis cartesian coordinate system to arrive at the desired location after which movement through pitch and yaw axes can be employed to arrive at the desired orientation of the cutting nozzle relative to the workpiece surface to be cut. Movement along a sixth axis coincident with the cutting axis of the nozzle can also be employed.

DESCRIPTION OF THE INVENTION

In accordance with the present invention there is provided a new and advantageous method and system for the remotely controlled cutting of a workpiece by abrasive jet cutting. The system comprises a head assembly having a support section and a nozzle body. Control means are provided for positioning the head assembly in a proximity to a workpiece which is to be cut. The control means functions to move the head assembly along a desired cutting path relatively to the workpiece. A nozzle is mounted in the nozzle body and oriented to dispense cutting fluid along an axis which is adapted to be directed against the workpiece. The nozzle body and the support section are interconnected by means which function to bias the nozzle body relative to the mounting section in a direction along the cutting axis of the nozzle. In a specific embodiment, the nozzle body is spring-loaded relative to the support section to bias the nozzle body in the desired direction. The nozzle body is provided with standoff means projecting away from the nozzle body by a distance sufficient to hold the nozzle off of the workpiece by the desired standoff distance. The standoff means terminates in a ski surface which is adapted to ride on a portion of the workpiece.

In a more specific embodiment of the invention, the standoff means has at least one chamfered surface oriented in the direction of travel of the nozzle. This chamfered surface functions to facilitate movement of the standoff means over the workpiece surface. Preferably the standoff means has at least two chamfered surfaces angularly disposed relative to one another.

In a preferred embodiment of the invention the standoff means comprises a U-shaped member having leg sections on each side of the nozzle. The outer surfaces of the leg sections and the conforming lower ends thereof are beveled to provide chamfered surfaces facilitating movement of the standoff means across the workpiece surface.

In a specific application of the present invention, there is provided a method for the abrasive jet cutting of a workpiece of the type having a panel portion and a plurality of stiffeners extending upwardly from the panel portion. A head assembly, as described above, is positioned in proximity to the workpiece. A high pressure stream of fluid containing abrasive particulate materials is directed from the nozzle along an axis impinging a stiffener of the workpiece. The nozzle is moved along the workpiece to produce a cutting kerf in the stiffener while a force is imposed on the nozzle body to bias the nozzle in a direction toward the stiffener. A standoff member is interposed between the nozzle body and stiffener to maintain the nozzle a desired standoff distance from the stiffener.

DETAILED DESCRIPTION OF THE INVENTION

The present invention is especially useful in horizontal cutting operations involving vertical surfaces such as in the shaping of panel stiffeners and will be described in detail with respect to this application. Air frame panels such as those made of composite materials are typically formed as integrated members having a main panel and a plurality of stiffener sections at intervals along the panel. After the composite structure is laid up and cured it is often desirable to cut the stiffeners to a desired configuration. In the cutting operation it is usually necessary that the surfaces be cut to very close measurements, for example, to a tolerance of no more than ±0.05 inch.

Figure 1:
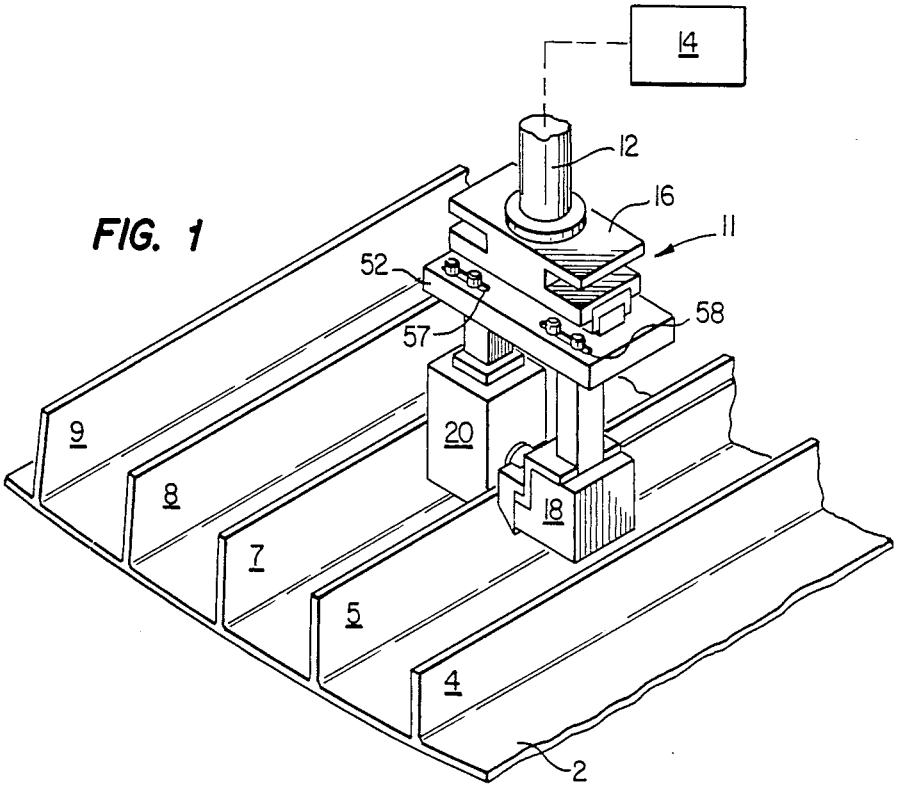
FIG. 1 is a perspective schematic illustration showing the application of the invention in the horizontal jet cutting of a panel provided with stiffeners.

Turning now to FIG. 1, there is illustrated a robotic abrasive water jet cutter incorporating the present invention which is employed to shape the stiffeners extending upwardly from the panel portion 2 of an air frame member. As shown in FIG. 1, stiffener 4 has been trimmed, the cutter is in the process of trimming stiffener 5 and stiffeners 7, 8 and 9 have yet to be trimmed. The robotic cutting system comprises a head assembly 11 which is secured to a gantry support system (not shown) by robot arm 12. The system is under control of a central controller 14. Controller 14, which normally will be in the form of a dedicated microprocessor, operates to position the head assembly at a desired location in proximity to the workpiece by manipulation along the x, y and z axis of an orthogonal axes system. The head assembly is rotated relative to the robot arm under the direction of the controller using pitch and yaw axes to orient the cutter nozzle at the desired orientation, in the embodiment shown in FIG. 1, normal to the surface of the stiffener. The head assembly is provided with high pressure plumbing hoses and abrasive and particulate supply hoses (none of which is shown), for the supply of particulates and water to form the high pressure abrasive containing jet stream. For a further description of a suitable robotic jet cutting system and its control, reference is made to the aforementioned SAE Paper No. 861,625 by Earle, the entire contents of which are incorporated herein by reference. A suitable material transfer system for the supply of fine abrasive particulates to the head assembly is described in U.S. patent application Ser. No. 901,482, filed Aug. 28, 1986, by Earle and Davis, the entire disclosure of which is incorporated herein by reference.

The head assembly illustrated in FIG. 1 comprises a head support section 16 secured to the robot arm 12 and adapted to be moved through the pitch and yaw axes relative to the arm as described above, and a nozzle body 18 and catcher vessel 20. The catcher vessel 20 preferably is of the type described in the aforementioned article by Earle. As described there, the vessel has a receiving aperture aligned with the jetting nozzle. As the jet stream passes through the kerf made in the stiffener it enters the receiver vessel through the receiving aperture. The kinetic energy of the stream is dissipated by contact with sacrificial elements within the catcher. The catcher vessel is provided with hoses (not shown) for the withdrawal of abraded sacrificial elements and the introduction of new elements.

The standoff distance between the nozzle tip of the jet cutter and the surface being cut is a very important parameter. For most applications the optimum standoff distance is about 0.1 inch. At this distance, when cutting composite materials a substantially finished cut is obtained thus eliminating the need for subsequent sanding and deburring to smooth the cut. If the standoff distance increases from the optimum by more than a few one hundredths of an inch, the kerf will widen to an unacceptable degree thereby undercutting the part. Severe undercutting can, of course, necessitate scrapping of the part. At the other extreme, if the minimum standoff distance is not accurately maintained, the nozzle tip could collide with the part resulting in damage both to the cutting system and to the working piece.

In the present invention, the optimum standoff distance is maintained by a simple mechanical relationship and without the need for sensors and feedback controls implemented through the microprocessor. This is accomplished in the present invention by physically incorporating a standoff implement on the nozzle body and slidably interconnecting the nozzle body (and also the catcher vessel in the preferred embodiment illustrated) on the head assembly in a manner to bias the nozzle body toward the cutting surface. This arrangement enables the correct standoff distance to be maintained at all times without the need for a sensor and feedback control system. Also, it eliminates the need for programming of the microprocessor to provide for movement of the head assembly along a sixth axis (coincident with the jet stream) in addition to the positioning movements along the x, y, and z axes of the Cartesian coordinate positioning system as well as the yaw and pitch axes to orient the direction of the jet stream relative to the cutting surface.

Figure 2:
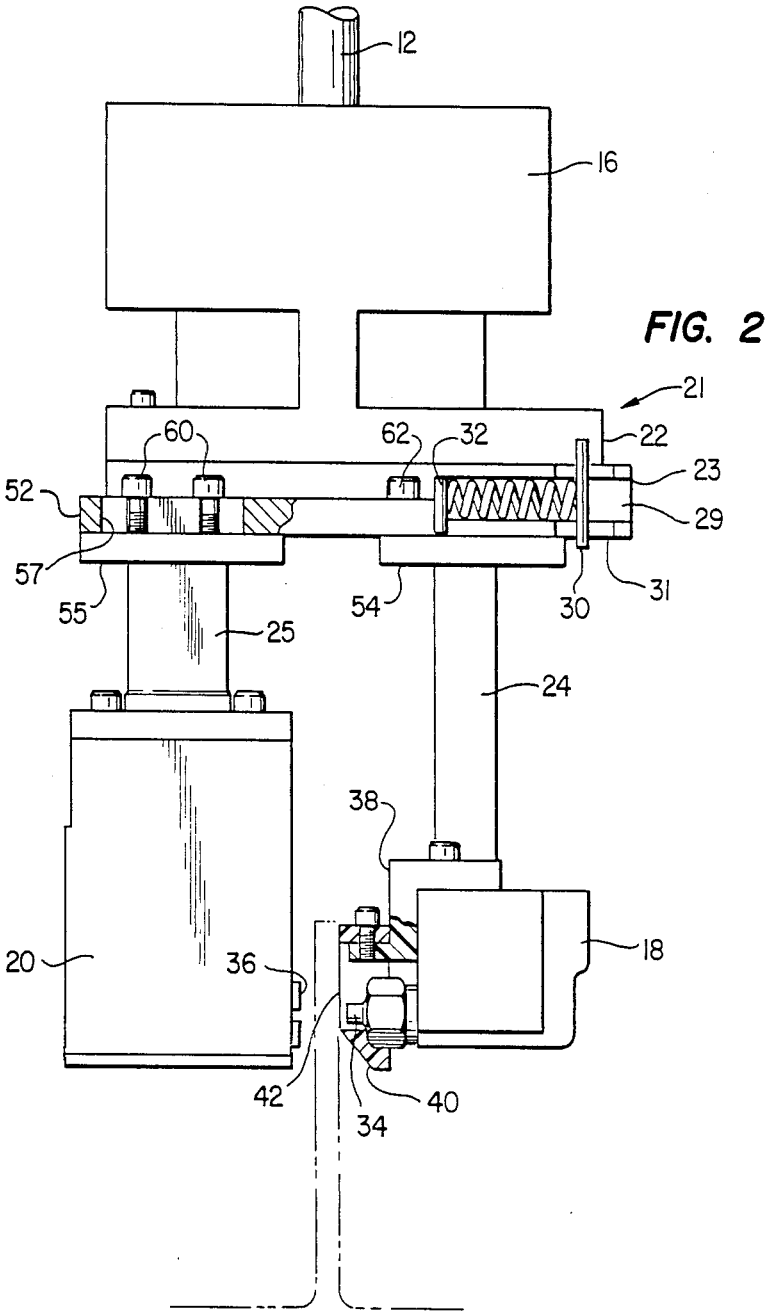
FIG. 2 is a side elevation of the head assembly shown in FIG. 1 illustrating the means for providing a desired standoff distance in accordance with the present invention.

The foregoing relationships are illustrated in detail in FIG. 2 which is a side elevational view, with parts broken away of the head assembly including the nozzle body and catcher of FIG. 1. The head assembly 11 comprises the support section 16 which slidably supports the nozzle body 18 and catcher vessel 20 through a precision ball slide assembly 21 having an upper member 22 secured to the support head 16 and a lower member 23. The lower ball slide member 23 is secured to the upper member 22 for movement over bearing surfaces provided by linear ball bearing segments (not shown) spaced parallel in the direction of travel. A suitable ball slide assembly for use in the present invention is a Del-Tron Model S2-2 available from Deltron Precision, Inc., Brookfield, Conn., with a plate attached to the lower subassembly to form the lower member 23 with a flange as described below.

The nozzle body 18 and catcher 20 are rigidly secured by means of depending mounting arms 24 and 25 to the lower ball slide member 23. As will be recognized from FIG. 2, by securing the nozzle body and catcher to the lower ball slide member through the rigid mounting arms 24 and 25 the catcher and nozzle body are mounted in a fixed spaced apart relationship relative to one another. The interconnection between the ball slide and the mounting section provides means for biasing the lower slide member, and therefore the nozzle and the catcher in a direction along the cutting axis of the nozzle. As shown in FIG. 2, this takes the form of a compression spring 28 mounted in a bore 29 extended into lower slide member 23. A pin 30 extends through a slot 31 formed in a lower ball slide member 23 and aligned with the bore 29 into a press fit with upper slide member 22. A second pin 32 is secured in the other end of bore 29. Pins 30 and 32 provide bearing shoulders between which the compression spring is interposed. The shoulder provided by pin 30 is fixed with respect to the upper ball slide member and the shoulder provided by pin 32, of course, moves with the lower ball slide member. The slot 31 provides means limiting the movement of the lower slide member relative to the upper slide member by abutment of the pin 30 with the ends of the slot. Thus, as can be seen from an examination of FIG. 2, the biasing action of the compression spring tends to move the bottom ball slide section and therefore the nozzle body and catcher vessel to the left as viewed in the FIGURE.

The nozzle body 18 is provided with an abrasive fluid jet nozzle 34 the cutting axis of which is aligned with a receiving aperture 36 in the catcher vessel 20. The jet stream which passes through the kerf in the working piece (shown in phantom in FIG. 2) enters the catcher vessel via the aperture where its kinetic energy is dissipated as described in greater detail in the aforementioned paper by Earle. The nozzle body is also provided with a bracket 38 on which is supported the mechanical standoff means 40 of the present invention. The outer bearing surface 42 of the standoff member 40 is adapted to ride on a portion of the workpiece being cut. Thus referring back to FIG. 1, the outer surface of standoff member 40 will ride against the vertical face of stiffener 5.

Figure 3:
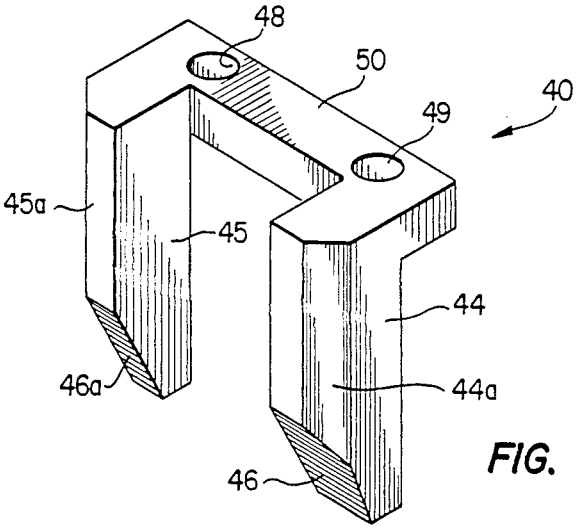
FIG. 3 is a perspective view of a preferred form of a standoff member employed in the present invention.

The standoff member 40 is illustrated in greater detail in FIG. 3. As shown there, standoff member is of a U-shaped configuration having vertical leg sections 44 and 45 and an upper mounting flange section 50 extending between the two vertical leg sections. Preferably, the bottoms and outer sides of the leg sections are beveled to provide chamfered surfaces facilitating movement of the standoff means across the workpiece in three directions. The bottom chamfered surfaces 46 and **46*a* of the legs 44 and 45 function to guide the nozzle body into the correct standoff relationship as it is lowered into place adjacent a stiffener (FIG. 1) which is to be cut. Thus, as the head assembly is lowered into place, the bottom chamfered surfaces 46 and 46*a*, upon contact with the top of a stiffener section, will tend to force the nozzle body back against the action of compression spring 28 so that once the outer surface 42 rides on the side of the stiffener, the desired standoff distance is reached. Beveled surfaces 44*a* and 45*a*** facilitate movement of the standoff member across the stiffener in either a backward or forward horizontal direction while maintaining the desired standoff distance.

The standoff member 40 is secured to the mounting bracket 38 by means of screws inserted through holes 48 and 49 in the upper mounting flange 50 of the standoff member.

From an examination of FIG. 3, it will be recognized that the spaced apart lower beveled edges 46 and **46*a* of the leg sections 44 and 45** guide the nozzle body into place over the stiffener section in a manner decreasing the likelihood of the nozzle body hanging up as it slides into place. The two leg sections which extend below the nozzle also provide protection for the nozzle. Similarly, the two legs sections, one on each side of the nozzle, are preferred in order to ensure that the nozzle tip will be retained in the desired orientation normal to the surface to be cut as well as the desired spacing from the surface to be cut.

The lower ball slide member 23 has a flange 52 to which the mounting arms 24 and 25 are secured by means of upper plates 54 and 55, respectively. The nozzle body and the catcher are held by virtue of their attachment to the ball slide flange in a fixed spaced apart relationship relative to one another during the cutting operation. At least one of the catcher and decrease the distance between the nozzle tip and the receiving aperture. Thus, as shown in FIG. 1, flange 52 is provided with longitudinal slots 57 and 58. The catcher vessel 20 is secured by bolts 60 which extend through slot 57 into tapped holes in plate 54. The nozzle body is similarly secured by means of bolts 62 which extend through slot 58 into the upper mounting plate associated with arm 24. Where it is desired to adjust either or both of the mounting arms 24 and 25 along the length of the flange 52, the appropriate bolts are simply loosened and the desired adjustments made within the range provided by the length of slots 57 and 58. This enables the nozzle spacing to be adjusted to provide for different workpiece thicknesses and also enables the catcher vessel to be adjusted to optimize its location relative to the nozzle, thus enabling the most efficient entrapment of the spent cutting stream.

Having described specific embodiments of the present invention, it will be understood that modification thereof may be suggested to those skilled in the art, and it is intended to cover all such modifications as fall within the scope of the appended claims.

We claim:

1. In a system for the remotely controlled cutting of a workpiece by abrasive jet cutting, the combination comprising:

a head assembly having a support section and a nozzle body;

control means for positioning said head assembly in proximity to a workpiece to be cut and for moving said head assembly along a desired cutting path;

a nozzle mounted in said nozzle body and oriented to dispense cutting fluid from said nozzle along a cutting axis adapted to be directed against the workpiece;

means interconnecting said nozzle body and said support section to bias said nozzle body relative to said support section in a direction along the cutting axis of said nozzle; and standoff means secured to said nozzle body and projecting away from said nozzle body by a distance sufficient to hold said nozzle off of said workpiece by a desired standoff distance, said standoff means terminating in a ski surface which is adapted to ride on a portion of said workpiece.

2. The combination of claim 1 wherein said standoff means has at least one chamfered surface in the direction of travel of said nozzle to facilitate movement of said standoff means over said workpiece.

3. The combination of claim 2 wherein said standoff means has at least two chamfered surfaces angularly disposed with respect to one another.

4. The combination of claim 1 wherein said standoff means comprises two leg sections extending on opposed sides of said nozzle.

5. The combination of claim 4 wherein the outer opposed edges of said leg sections are beveled to provide chamfered surfaces to facilitate movement of said standoff means across the workpiece.

6. The combination of claim 5 wherein the conforming ends of said leg sections are beveled to provide a chamfered surface.

7. In a system for the remotely controlled cutting of a workpiece by abrasive jet cutting, the combination comprising:

a head assembly having a support section, a nozzle body and a catcher vessel having a receiving aperture, said nozzle body and said catcher vessel depending from said support section in a fixed spaced apart relationship in which the receiving aperture faces the nozzle body;

control means for positioning said head assembly in proximity to a workpiece to be cut and for moving said head assembly along a desired cutting path;

a nozzle mounted in said nozzle body and oriented to dispense cutting fluid from said nozzle along a cutting axis adapted to be directed against the workpiece and aligned with said receiving aperture;

means interconnecting said nozzle body and catcher vessel with said support section to bias said nozzle body and catcher vessel relative to said support section in a direction along the cutting axis of said nozzle; and standoff means secured to said nozzle body between said nozzle body and said catcher vessel and projecting away from said nozzle body by a distance sufficient to hold said nozzle off of said workpiece by a desired standoff distance, said standoff means terminating in a ski surface which is adapted to ride on a portion of said workpiece.

8. The combination of claim 7 further comprising means for adjusting the fixed distance between said nozzle body and said catcher vessel in order to vary the distance between the tip of said nozzle and the receiving aperture of said catcher vessel.

9. The combination of claim 8 wherein said nozzle body and said catcher vessel are each secured to a flange member which is biased for movement relative to said support section, and wherein each of said catcher vessel and said nozzle body can be secured at different locations along said flange member.

10. The combination of claim 7 wherein said standoff means has at least one chamfered surface in the direction of travel of said nozzle to facilitate movement of said standoff means over said workpiece.

11. The combination of claim 10 wherein said standoff means has at least two chamfered surfaces angularly disposed with respect to one another.

12. The combination of claim 7 wherein said standoff means comprises two leg sections extending on opposed sides of said nozzle.

13. The combination of claim 12 wherein the outer opposed edges of said leg sections are beveled to provide chamfered surfaces to facilitate movement of said standoff means across the workpiece.

14. The combination of claim 13 wherein the bottom conforming ends of said leg sections are beveled to provide a chamfered surface.

* * * * *